US008424985B2

(12) United States Patent
Kwon et al.

(10) Patent No.: US 8,424,985 B2
(45) Date of Patent: Apr. 23, 2013

(54) REFRIGERATOR WITH A DOOR-IN-DOOR

(75) Inventors: Hong Sik Kwon, Seoul (KR); Yong Hun Chang, Seoul (KR); Jung Yeon Hwang, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 12/834,919

(22) Filed: Jul. 13, 2010

(65) Prior Publication Data

US 2011/0023527 A1 Feb. 3, 2011

(30) Foreign Application Priority Data

Jul. 28, 2009 (KR) ..... 10-2009-0069025

(51) Int. Cl.
*A47B 96/00* (2006.01)

(52) U.S. Cl.
USPC ..... 312/405; 312/292

(58) Field of Classification Search ..... 312/401, 312/402, 404, 405, 324, 326, 405.1, 291, 312/292; 62/448, 449
See application file for complete search history.

(56) References Cited

U.S. PATENT DOCUMENTS

| | | | | |
|---|---|---|---|---|
| 1,275,511 | A | | 8/1918 | Welch |
| 1,984,977 | A | | 12/1934 | Mize |
| 2,046,909 | A | | 7/1936 | Terry et al. |
| 2,062,360 | A | | 12/1936 | Goulooze |
| 2,095,811 | A | | 10/1937 | Goulooze |
| 2,112,771 | A | | 3/1938 | Goulooze |
| 2,129,923 | A | * | 9/1938 | Frankel ..... 312/236 |
| 2,131,680 | A | | 9/1938 | Zahodiakin |
| 2,150,064 | A | * | 3/1939 | John et al. ..... 62/266 |
| 2,281,430 | A | | 4/1942 | Grant |
| 2,385,169 | A | | 9/1945 | Stone |
| 2,653,851 | A | * | 9/1953 | Davidson ..... 312/348.6 |
| 2,656,688 | A | | 10/1953 | Hinkel |
| 2,783,115 | A | * | 2/1957 | York ..... 312/325 |
| 2,942,438 | A | * | 6/1960 | Schmeling ..... 62/377 |

(Continued)

FOREIGN PATENT DOCUMENTS

| | | | |
|---|---|---|---|
| EP | 0539558 | A1 | 11/1992 |
| JP | 10-009757 | A | 1/1998 |

(Continued)

OTHER PUBLICATIONS http://www.samsung.com/sec/consunner/kitchen-appliances/refrigerators/zipel/SRT746AW . . . Mar. 31, 2010, with English translation, 4 pages.

(Continued)

*Primary Examiner* — James O Hansen
*Assistant Examiner* — Sasha T Varghese
(74) *Attorney, Agent, or Firm* — Fish & Richardson P.C.

(57) ABSTRACT

A refrigerator includes a cabinet configured to define an exterior boundary of the refrigerator. The refrigerator also includes a first storage chamber configured to store food stuffs and a first door configured to open and close the first storage chamber. The refrigerator further includes a second storage chamber defined at a side of the first door, and configured to enable access to food stuffs while the first door remains closed and a second door located in a predetermined portion of the first door, and configured to open and close the second storage chamber, wherein a rotation direction of the second door is identical to a rotation direction of the first door.

31 Claims, 13 Drawing Sheets

U.S. PATENT DOCUMENTS

| | | | | | |
|---|---|---|---|---|---|
| 2,945,733 | A | * | 7/1960 | Malia | 312/200 |
| 3,086,830 | A | * | 4/1963 | Malia | 312/200 |
| 3,218,111 | A | | 11/1965 | Steiner | |
| 3,287,079 | A | * | 11/1966 | Courson | 312/291 |
| 3,299,573 | A | | 1/1967 | Gustafson | |
| 3,389,424 | A | | 6/1968 | Fellwock | |
| 3,395,423 | A | | 8/1968 | Antonius | |
| 3,510,986 | A | | 5/1970 | Berkowitz | |
| 3,619,853 | A | | 11/1971 | Merrill | |
| 3,643,464 | A | | 2/1972 | Hilliker et al. | |
| 3,766,599 | A | | 10/1973 | Ullman | |
| 3,874,027 | A | | 4/1975 | Parsons | |
| 3,883,204 | A | | 5/1975 | Prada et al. | |
| 4,084,291 | A | | 4/1978 | Crowe | |
| 4,087,140 | A | | 5/1978 | Linstromberg | |
| 4,133,143 | A | | 1/1979 | Campisano | |
| 4,269,039 | A | | 5/1981 | Baker | |
| 4,368,557 | A | | 1/1983 | Inasawa et al. | |
| 4,368,622 | A | | 1/1983 | Brooks | |
| 4,503,583 | A | | 3/1985 | Frohbieter | |
| 4,586,347 | A | | 5/1986 | McCarty | |
| 5,209,082 | A | * | 5/1993 | Ha | 62/265 |
| 5,411,328 | A | * | 5/1995 | You | 312/405 |
| 5,600,966 | A | * | 2/1997 | Valence et al. | 62/440 |
| 5,966,963 | A | * | 10/1999 | Kovalaske | 62/441 |
| 6,055,823 | A | | 5/2000 | Baker et al. | |
| 6,056,378 | A | | 5/2000 | Semon et al. | |
| 6,375,291 | B1 | | 4/2002 | Nam et al. | |
| 6,547,349 | B2 | | 4/2003 | Sessa et al. | |
| D508,249 | S | | 8/2005 | Seok et al. | |
| D527,398 | S | | 8/2006 | Kim et al. | |
| 7,198,340 | B1 | | 4/2007 | Ertz | |
| 7,254,958 | B2 | | 8/2007 | Kim et al. | |
| 7,784,219 | B2 | | 8/2010 | Yoshikawa et al. | |
| D629,021 | S | | 12/2010 | Cho et al. | |
| 2002/0093276 | A1 | | 7/2002 | Kawakami | |
| 2005/0188506 | A1 | * | 9/2005 | Lee et al. | 16/376 |
| 2005/0258724 | A1 | | 11/2005 | Hwa | |
| 2009/0139260 | A1 | | 6/2009 | Yoshikawa et al. | |
| 2009/0273264 | A1 | | 11/2009 | Butler | |
| 2010/0170279 | A1 | | 7/2010 | Aoki | |
| 2010/0307186 | A1 | | 12/2010 | Kwon et al. | |
| 2011/0023527 | A1 | | 2/2011 | Kwon et al. | |
| 2011/0023528 | A1 | | 2/2011 | Kwon et al. | |
| 2011/0146323 | A1 | | 6/2011 | Choi | |
| 2011/0232317 | A1 | | 9/2011 | Flores | |
| 2011/0232323 | A1 | | 9/2011 | Morris | |

FOREIGN PATENT DOCUMENTS

| | | | |
|---|---|---|---|
| KR | 20-1990-0008203 | Y1 | 9/1990 |
| KR | 20-1996-0008835 | U | 3/1996 |
| KR | 10-1997-0007503 | B1 | 5/1997 |
| KR | 10-19990042339 | A | 6/1999 |
| KR | 10-1999-074448 | A | 10/1999 |
| KR | 20-1999-0039593 | A | 11/1999 |
| KR | 20-0164322 | Y1 | 2/2000 |
| KR | 20-0183300 | Y1 | 5/2000 |
| KR | 10-0376167 | B1 | 3/2003 |
| KR | 10-2003-083813 | A | 11/2003 |
| KR | 10-2005-0111094 | A | 11/2005 |
| KR | 10-0596533 | B1 | 7/2006 |
| KR | 10-0887575 | B1 | 3/2009 |
| KR | 10-2009-0077564 | A | 7/2009 |

OTHER PUBLICATIONS

PCT International Search Report dated Dec. 20, 2010 for Application No. PCT/KR/2010/003542, 3 pages.

PCT International Search Report dated Dec. 23, 2010 for Application No. PCT/KR/2010/003616, 3 pages.

PCT International Search Report dated Dec. 23, 2010 for Application No. PCT/KR/2010/003617, 3 pages.

U.S. Office Action dated Apr. 16, 2012 for U.S. Appl. No. 12/792,601, 15 pages.

* cited by examiner (a)

(b)

(c)

REFRIGERATOR WITH A DOOR-IN-DOOR

CROSS REFERENCE TO RELATED APPLICATION

This application claims the benefit of the priority to Korean Application No. 10-2009-0069025, filed on Jul. 28, 2009, which is hereby expressly incorporated by reference as if fully set forth herein.

FIELD

The present disclosure relates to a refrigerator.

BACKGROUND

Refrigerators have storage chambers for storing food stuffs and the storage chambers are selectively closed by doors. In general, such a storage chamber may be classified into a freezer chamber and a refrigerator chamber, and refrigerators may be classified into several types based on freezer/refrigerator chamber arrangement, door appearance or door closing structure.

Typically, predetermined space for preserving food stuffs is defined by a door. For example, a predetermined space, that is, a door basket is provided in the door to preserve food stuffs contained in relatively tall containers, for example, bottles. A user opens the door to put or take the food stuffs into or out of the door basket provided in the door. That is, the door basket is accessible from an inner side of the door. Another type of food storage space provided in the door is a storage chamber commonly called as a home bar. Such the storage chamber, namely, a home bar is provided in the door and it is accessible from an outer side of the door via an auxiliary door additionally provided in the door. That is, without opening the door, the user opens the auxiliary door to put or take in or out food stuffs provided in the door storage chamber. As mentioned above, the structure of the refrigerator has been diversified and demands for improving user convenience of the refrigerator have been increasing accordingly.

SUMMARY

In one aspect, a refrigerator includes a cabinet configured to define an exterior boundary of the refrigerator. The refrigerator also includes a first storage chamber configured to store food stuffs and a first door configured to open and close the first storage chamber. The refrigerator further includes a second storage chamber defined at a side of the first door, and configured to enable access to food stuffs while the first door remains closed and a second door located in a predetermined portion of the first door, and configured to open and close the second storage chamber, wherein a rotation direction of the second door is identical to a rotation direction of the first door. In addition, the refrigerator includes a third storage chamber defined at a side of the first door, and configured to enable access to food stuffs while the first door remains and a third door, located in a predetermined portion of the first door, configured to open and close the third storage chamber, wherein a rotational direction of the third door is perpendicular to the rotational direction of the first and second doors.

Implementations may include one or more of the following features. For example, the second storage chamber and the third storage chamber are provided independently. The second storage chamber and the third storage chamber are located adjacent to each other. The refrigerator further includes a recess positioned at least one of the first, second, third doors and configured to be recessed horizontally to be used as a handle. The refrigerator further includes a groove positioned at the first door, and configured to be recessed vertically. A groove recessed vertically is provided in the first door and a recess recessed horizontally is provided in the first door.

In some examples, the refrigerator further includes a push-spring structure positioned at least one of the first, second and third door to open the at least one of the doors. The push-spring structure positioned at the third door. The refrigerator further includes a rotational axis establishing means coupled to the first and second doors, and configured to establish a rotational axis of the first and second doors. The rotational axis establishing means is a rotational shaft. The rotational axis establishing means is located in the second door.

The refrigerator further includes a first connection member configured to connect the rotational axis establishing means of the first door to the cabinet. The refrigerator further includes a second connection member configured to the second door to the first door. The refrigerator further includes a securing part located in the first door, and configured to secure the second door. A lower surface of the second door is rotatably coupled to the first door. The first door further includes a first recess configured to be recessed toward the cabinet from a lower surface of the securing part. The first door further includes a second recess configured to be recessed downward from a predetermined portion adjacent to the first recess. The refrigerator further includes a third recess configured to be recessed upward from a lower portion of the first door. A first rotational axis establishing means coupled to the first door and configured to establish a first rotational axis and a second rotational axis establishing means coupled to the second door and configured to establish a second rotational axis.

The refrigerator further includes a first connection member configured to the first door to the cabinet. The refrigerator further includes a second connection member configured to connect the second door to the first door. An appearance of the second door is corresponding to an appearance of the first door. A width of the second door is substantially identical to a width of the first door. A rotational shaft of the first door is parallel to a rotational shaft of the second door. The refrigerator further includes a door basket positioned inside the first door, and configured to be accessible when the first door is opened.

In another aspect, a refrigerator includes a cabinet configured to define an exterior boundary of the refrigerator. The refrigerator also includes a first storage configured to store food stuffs and a first door configured to open and close the first storage chamber. The refrigerator further includes a second storage chamber defined at a side of the first door, and configured to enable access to food stuffs while the first door remains and a second door located in a predetermined portion of the first door, and configured to open and close the second storage chamber, wherein a rotation direction of the second door is identical to a rotation direction of the first door. In addition, the refrigerator includes a third storage chamber defined at a side of the first door, and configured to enable access to food stuffs while the first door remains and a third door, located in a predetermined portion of the first door, configured to open and close the third storage chamber, wherein a rotational direction of the third door is different from the rotational direction of the first and second doors.

Implementations may include one or more of the following features. For example, an upper surface of the first door and an upper surface of the second door have an identical level. The refrigerator further includes a push-spring structure positioned at the third door to open the third door.

In yet another aspect, a refrigerator includes a cabinet configured to define an exterior boundary of the refrigerator. The refrigerator also includes a first storage configured to store food stuffs and a first door configured to open and close the first storage chamber. The refrigerator further includes a second storage chamber defined at a side of the first door, and configured to enable access to food stuffs while the first door remains and a second door located in a predetermined portion of the first door, and configured to open and close the second storage chamber. In addition, the refrigerator includes a third storage chamber defined at a side of the first door, and configured to enable access to food stuffs while the first door remains and a third door, located in a predetermined portion of the first door, configured to open and close the third storage chamber, wherein a rotation direction of the third door is identical to a rotation direction of the first door.

Implementations may include one or more of the following features. For example, the rotation direction of the third door is identical to a rotation direction of the second door.

DETAILED DESCRIPTION

Reference will now be made in detail to various implementations of the present technology, examples of which are illustrated in the accompanying drawings. Wherever possible, the same reference numbers will be used throughout the drawings to refer to the same or like parts.

As follows, a refrigerator according to an exemplary implementation will be described in reference to the accompanying drawings.

Figure 1:
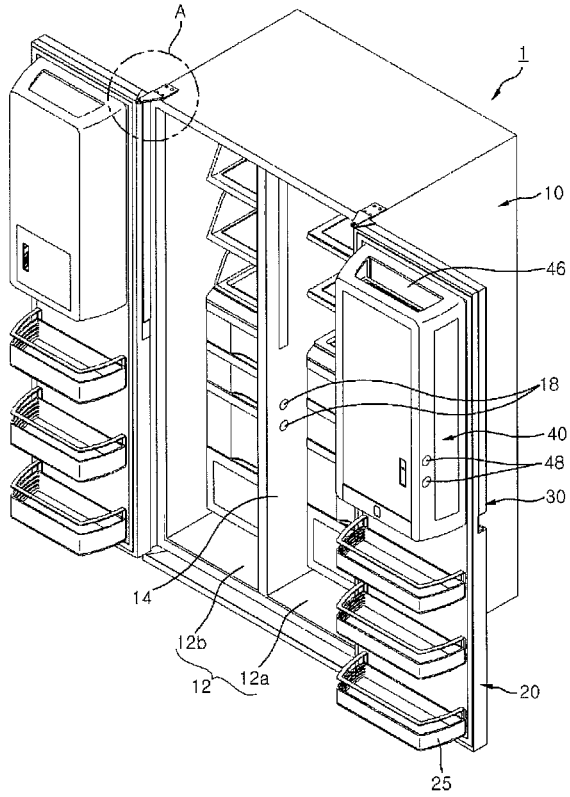
FIG. 1 is a view illustrating a refrigerator in a state of a first storage chamber being opened.

In reference to FIG. 1, an overall structure of the refrigerator will be described. A side by side type refrigerator is embodied to describe the present disclosure for convenience sake, although the present invention not limited thereto.

A first storage chamber 12 is provided in a cabinet 10 of the refrigerator 1 to preserve food stuffs therein. The first storage chamber 12 may include a freezer chamber 12*b* and a refrigerator chamber 12*a*. The freezer chamber 12*b* and the refrigerator chamber 12*a* are arranged horizontally, that is, side by side.

A first door 20 is provided in the cabinet 10 to open and close the first storage chamber 12 selectively. A second storage chamber 40 is provided in the first door 20 to preserve food stuffs therein, and the second chamber 40 is opened and closed by a second door 30 selectively.

Each of the above configurations will be described in detail as follows.

The first storage chamber 12 defined in the cabinet 10 of the refrigerator 1 is partitioned into the freezer chamber 12*b* and the refrigerator chamber 12*a* by a partition wall 14. Here, at least one shelf and drawer may be installed in the first storage chamber 12.

The second storage chamber 40 is defined in the first door 20, and it has a predetermined space to preserve food stuffs. The second storage chamber 40 is configured to surround the predetermined space. That is, the second storage chamber 40 has the predetermined space positioned at inside of the first door 20 so that the second chamber 40 can be accessible from an outside of the first door 20. In this implementation, the second storage chamber 40 is further accessible through an inside of the first door 20, and the second storage chamber 40 is further accessible via a second door 30 coupled to the first door 20. Another type of storage space, namely, a door basket 25 may be defined in the inner side of the first door 20, different from the second storage chamber 40. The door basket 25 is accessible from the inner side of the first door 20. In other words, the door basket 25 is not accessible via the second door 30 and it is accessible after the first door 20 is opened.

In some examples, the second storage chamber 40 is typically a predetermined surrounded space and it may include that a structure capable of providing cold air to the second storage chamber 40. The second storage chamber may include a first communication part 46 in communication with the first storage chamber 12 such that cold air of the first storage chamber 12 is supplied to the second storage chamber 40. A second communication part 48 in direct communication with an end 18 of a cold air duct positioned on the partition wall 14 of the cabinet 10, may be defined in the second storage chamber 40.

Figure 2:
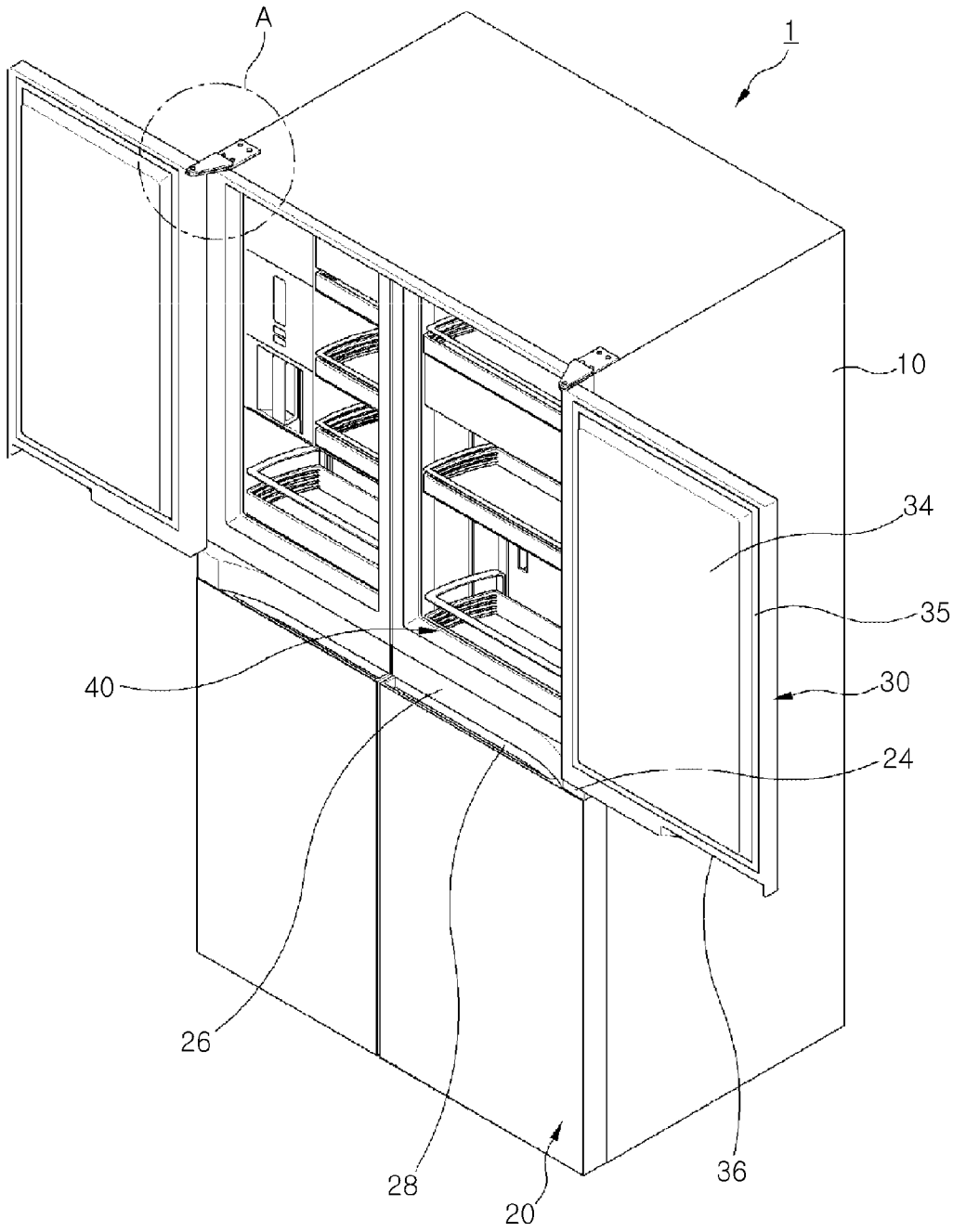
FIG. 2 is a view illustrating the refrigerator in a state of a second storage chamber being opened.

In reference to FIG. 2, the first door and the second door will be described in detail.

The first door 20 includes a securing part 21 (see, FIG. 3) recessed toward the cabinet 10 and the second door 30 may be secured in the securing part 21. A step 29 stepped toward the cabinet 10 is defined in a predetermined portion of the first door 20, for example, approximately a middle portion of the first door in FIGS. 2 and 3.

The appearance of the second door 30 may be corresponding to the appearance of the first door 20, although it may be otherwise configured. Especially, the width of the second door 30 may be substantially identical to the width of the first door 20 and the height of the second door 30 may be adjustable. The thickness of the second door 30 may be identical to the thickness of the securing part 21. In this implementation, the position or the height of the second door 30 defined in a predetermined portion of the first door 20 is changed or adjusted, and a user recognizes the second door 30 as the first door 20 itself or a part of the first door 20, such that beauty of the refrigerator 1 may not be damaged.

In the implementation, a first recess 26 which is recessed inward, may be located in a predetermined portion of the first door 20, for example, between a lower surface of the second door 30 and a coupling part 24 that is rotatably coupled to the first door. A second recess 28 recessed downward from the first recess 26 may be located in the first door 20. A third recess 36 recessed upward from a lower surface of the second door 30, which is adjacent to the first recess 26, may be located in the second door 30. This configuration allows the second and third recesses 28 and 36 to function as handles for the first and second doors, respectively, and thus auxiliary handles needed in the first and second doors 20 and 30.

A projection part 34, projected upward, is defined in the second door 30 and a gasket 35 may be coupled to a circumstance of the projection part 34 for sealing the second door 30.

In reference to FIG. 3, a coupling and rotation structure of the first door and the second door will be described. As an example, the second door 30 is secured in the securing part 21 of the first door 20.

The first door 20 opens and closes the first storage chamber 12 selectively and the second door 30 opens and closes the second storage chamber defined in the first door 20. In this implementation, a rotational direction of the first door 20 is identical to that of the second door 30. For example, the first door 20 is rotatable with respect to a vertical shaft in the conventional refrigerator and the second door 30 is also rotatable with respect to the vertical shaft.

If the rotational direction of the first door 20 is identical to that of the second door 30, a rotational radius of the conventional refrigerator 1 may be determined based on the first door 20 for opening and closing the first storage chamber. As a result, the user should arrange the refrigerator without any obstacles placed in the rotational radius of the first door 20. Also, if the rotational direction of the second door 30 is identical to that of the first door, it may be possible to increase the size of the second storage chamber defined in the first door 20. Also, if the rotational directions of the first and second doors 20 and 30 are identical, the sealing structure between the first and second doors 20 and 30 may be applicable to the sealing structure between the cabinet 10 and the first door 20.

Here, the rotational shaft of the first door 20 is parallel to the rotational shaft of the second door 30 and it is preferable that the rotational shafts of the first and second doors 20 and 30 are located on the same line, such that a single rotational shaft may be used to simplify an assembly structure of the refrigerator.

This configuration will be described in detail as follows.

Figure 4:
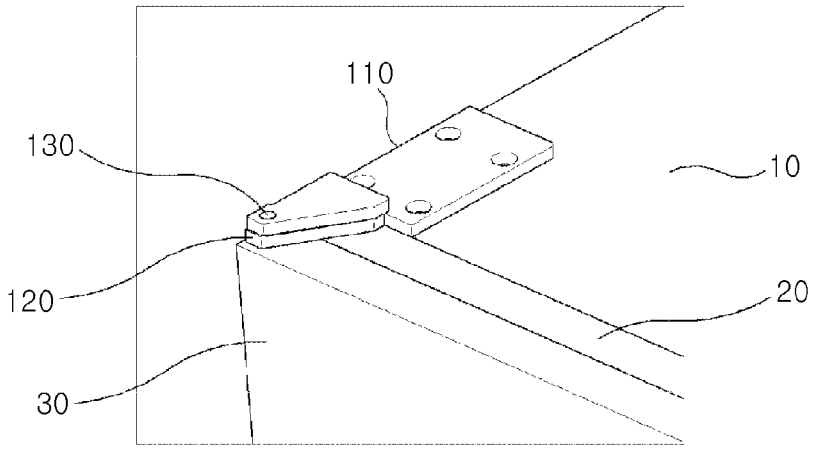
FIG. 4 is a diagram illustrating a first door and a second door of the refrigerator, in a state of being opened.
Figure 4:
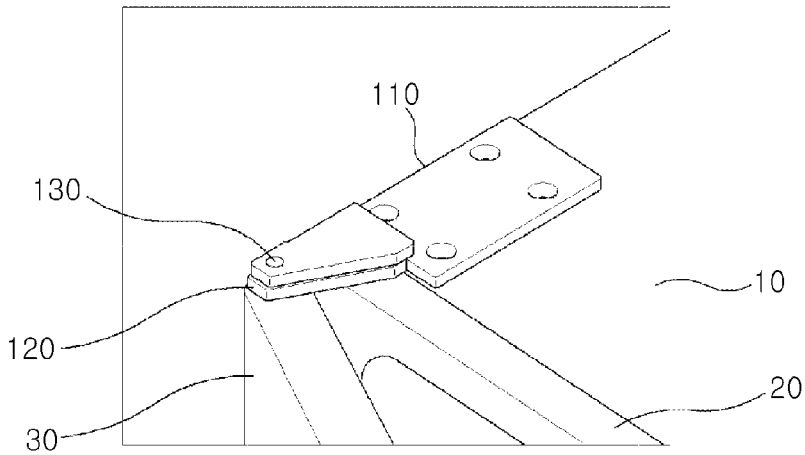
Figure 4:
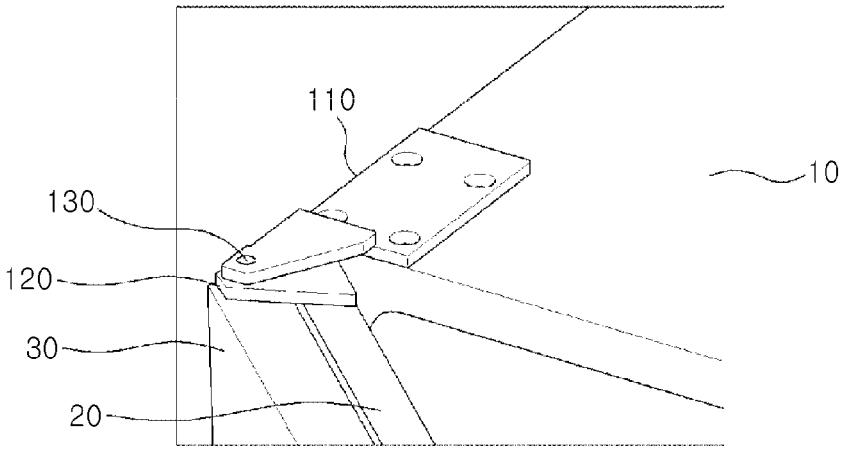

Referring to FIG. 4, a structure to selectively open and close the first door 20 and the second door includes a first connection member 110, a second connection member 120 and a rotational shaft 130.

An end of a first connection member 110 is coupled to an upper surface 14 of the cabinet 10 and the other end of the connection member 110 is connected to an upper surface of the second door 30 through the medium of the rotational shaft 130. An end of a second connection member 120 is coupled to an upper surface of the first door 20 and the other end of the second connection member 120 is connected to the upper surface of the second door 30 through the medium of the same upper rotational shaft 130. In this implementation, the second connection member 120 may be located below the first connection member 110. As a result, the upper rotational shaft 130 is employed as a common rotational shaft for the first and second doors 20 and 30.

Figure 3:
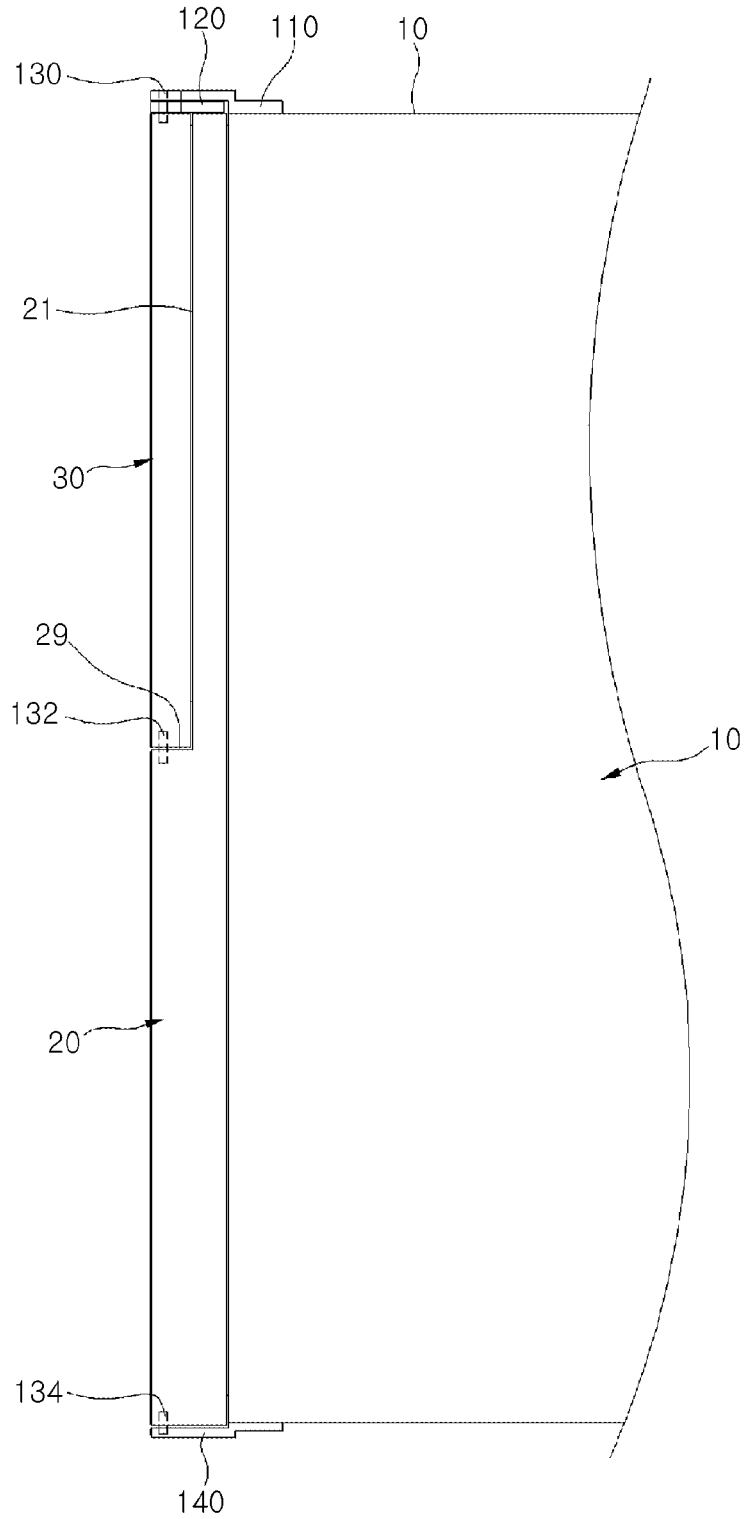
FIG. 3 is a longitudinal-sectional view of FIG. 1.

Referring to FIG. 3, a rotational shaft 132 for a lower portion of the second door 30 is defined in a lower surface of the second door 30. The lower second door rotational shaft 132 is connected to the coupling part 24 as shown in FIG. 2. The coupling part 24 may be defined in the securing part 21 of the first door 20. A rotational shaft 134 for a lower portion of the first door 20 is provided in a lower surface of the first door 20, and the lower rotational shaft 134 is connected to a lower surface of the cabinet 10 by a third connection member 140, as shown in FIG. 4.

FIG. 4A shows a configuration of the upper structure in a close state of the first and second doors 20 and 30.

FIG. 4B shows a configuration of the upper structure in an open state of the first and second doors 20 and 30. A user can open the second door 30 to approach to the second storage chamber 40 defined in the first door 20. If the user pulls only the second door 30 in a forward direction by using the handle 36 as shown in FIG. 1, the second door 30 is rotated with respect to the common upper rotational shaft 130 and the lower rotational shaft 132 (see, FIG. 3), so the second storage chamber 40 is opened.

FIG. 4C shows a configuration of the upper structure in an open state of the first door 20.

The user can open the first door 20 to approach to the first storage chamber 12. If the user pulls the first door 20 forward by using a handle 28 as shown in FIG. 1, the first and second doors are rotated together with respect to the common upper rotational shaft 130 and the lower first door rotational shaft 134 (see, FIG. 3) and then the first storage chamber 12 is opened. In this implementation, the second connection member 120 is rotated such that the first and the second doors 20 and 30 can rotate together.

Figure 5:
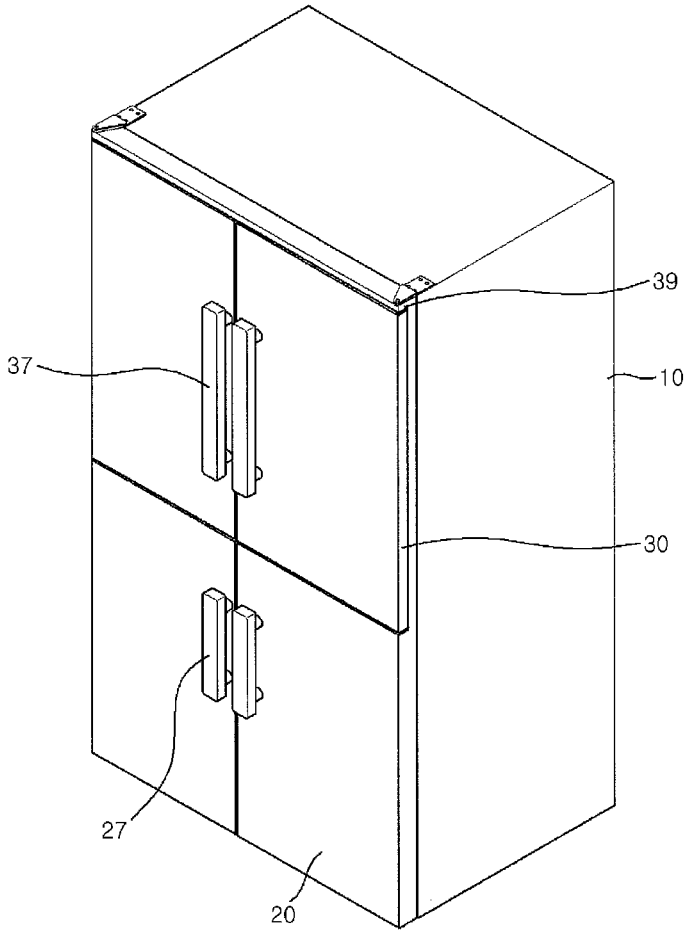
FIG. 5 is a view illustrating a refrigerator.

As an example, FIG. 5 shows a handle 27 for opening and closing the first door 20 and a handle 37 for opening and closing the second door positioned on outer surfaces of the first and second doors 20 and 30, respectively. As mentioned in the description, a recess used as a handle may be defined in the first and second doors, respectively.

Figure 6:
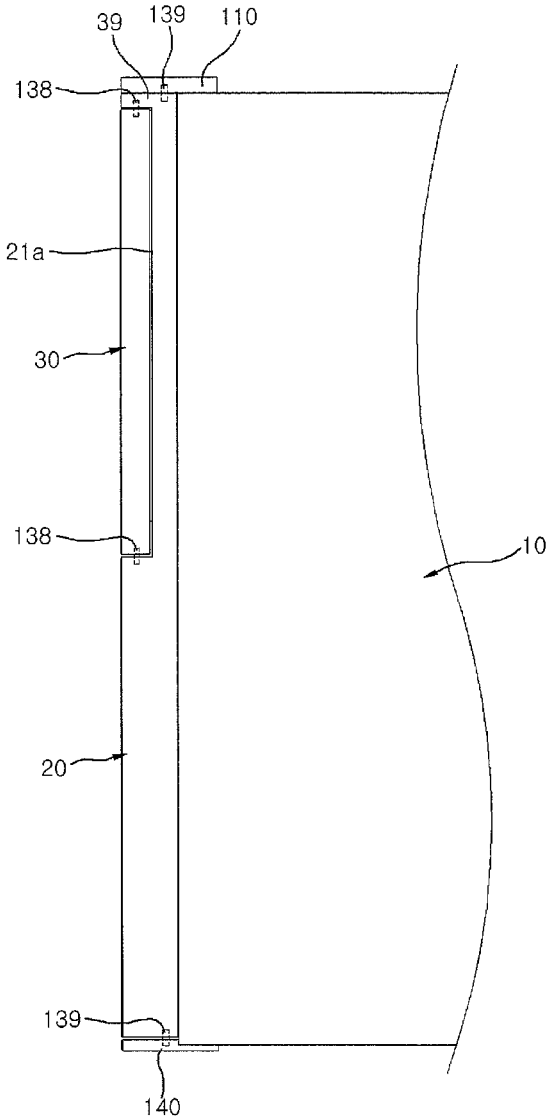
FIG. 6 is a longitudinal-sectional view.

Referring to FIG. 6, this implementation is similar to the previous implementation for example, two door structure, but, the structure to selectively open the first door 20 and the second door 30 is modified. For example, appearance of the securing part 21 of the first door 20 is modified. As shown in FIG. 3, in the previous implementation, an upper portion of the securing part 21 of the first door 20 is exposed such that the upper surfaces of the first and second doors 20 and 30 are at an identical level. In this implementation, a projection part 39 is defined in an upper portion of the first door 20 to rotatably couple the upper surface of the second door 30 to a lower surface of the projection part 39. As a result, the upper surface of the second door 20 is located under the projection part 39 of the first door 20.

As shown in FIG. 6, a pair of rotational shafts for the first door 139 may be defined in the first door 20 and a pair of rotational shafts for the second door 138 may be provided in the second door 30. The first door rotational shaft 139 and the second door rotational shaft 138 are parallel but offset.

In some implementations, the first door rotational shaft 139 and the second door rotational shaft 138 may be located at the same shaft line. In this case, an upper rotational shaft of the first door 20 and an upper rotational shaft of the second door 30 may be on the same rotational shaft line.

In case of a structure of a securing part 21*a*, a hinge structure may be installed in inner surfaces of the first and second doors 20 and 30, instead of the rotational shaft 138 of the second door 30.

FIG. 5 and FIG. 6 show a handle 27 for the first door and a handle 37 for the second door provided on outer surfaces of the first and second doors 20 and 30, respectively, and the present disclosure is not limited thereto. As mentioned in the description of the above embodiment, the recess used as handles may be provided in the first and second doors, respectively.

Figure 7:
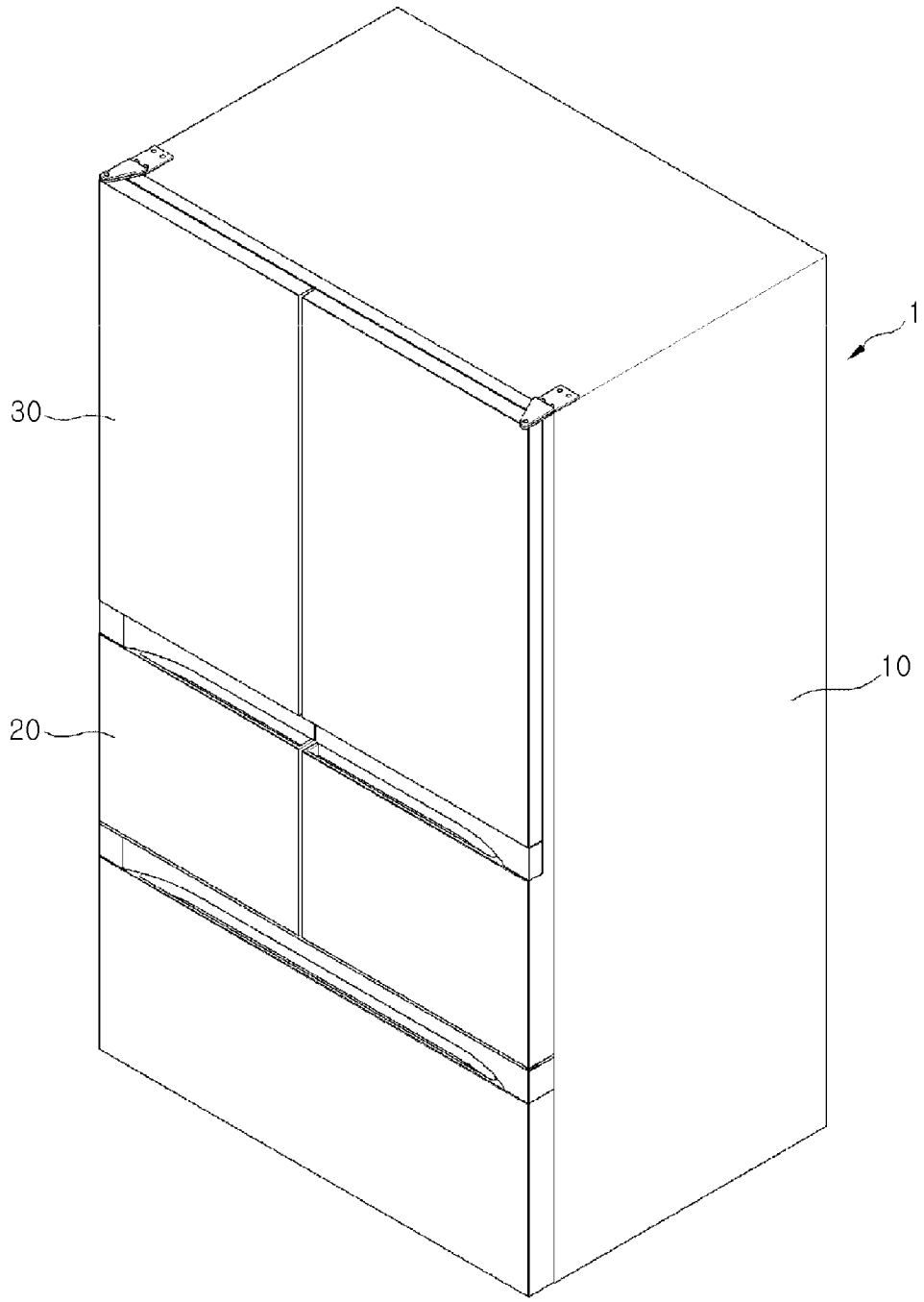
FIG. 7 is a view illustrating a refrigerator.

The side by side type refrigerator is presented to describe the implementations and so, the present disclosure is not limited thereto. The present invention is applicable to a top freezer type having a freezer chamber placed on a refrigerator chamber or a bottom freezer type having a freezer chamber arranged under a refrigerator chamber. Referring to FIG. 7, the present invention may be applicable to a refrigerator having the refrigerator chamber arranged in the upper portion of the cabinet and the freezer chamber defined in the lower portion of the cabinet. Also, the present disclosure may be applicable to a refrigerator having a closable freezer chamber that is a drawer type and a refrigerator chamber having a pair of doors opened and closed with respect to a pair of vertical shafts.

Further, the appearance of the first door is corresponding to that of the second door. For example, the width of the first door is identical to the width of the second door and the length of the second door is smaller than the length of the first door. Here, the present invention is not limited thereto. That is, the present disclosure may be applicable to a case in that both of the width and the height of the second door may be smaller than those of the first door.

The refrigerator may include another type of door that is rotatable along a predetermined rotational direction different from that of the first door. In reference to FIGS. 8 and 9, this case will be described in detail as follows.

Figure 8:
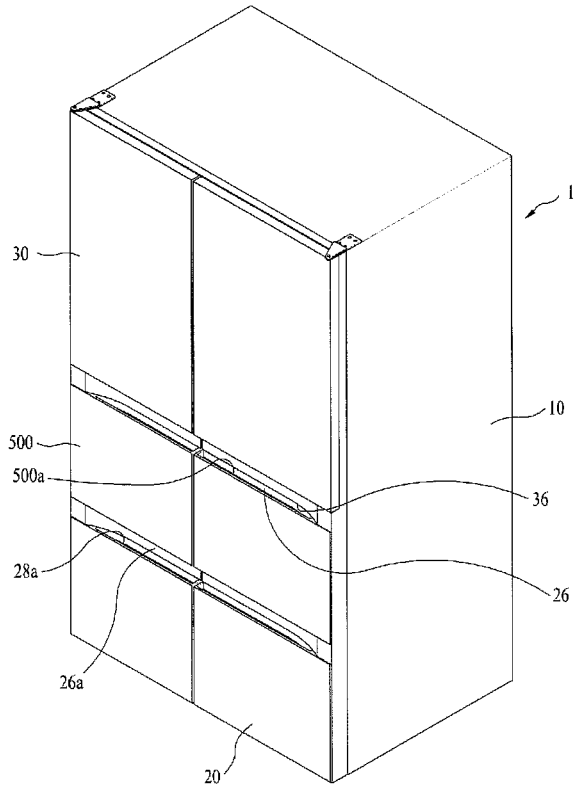
FIG. 8 is a view illustrating a refrigerator.
Figure 9:
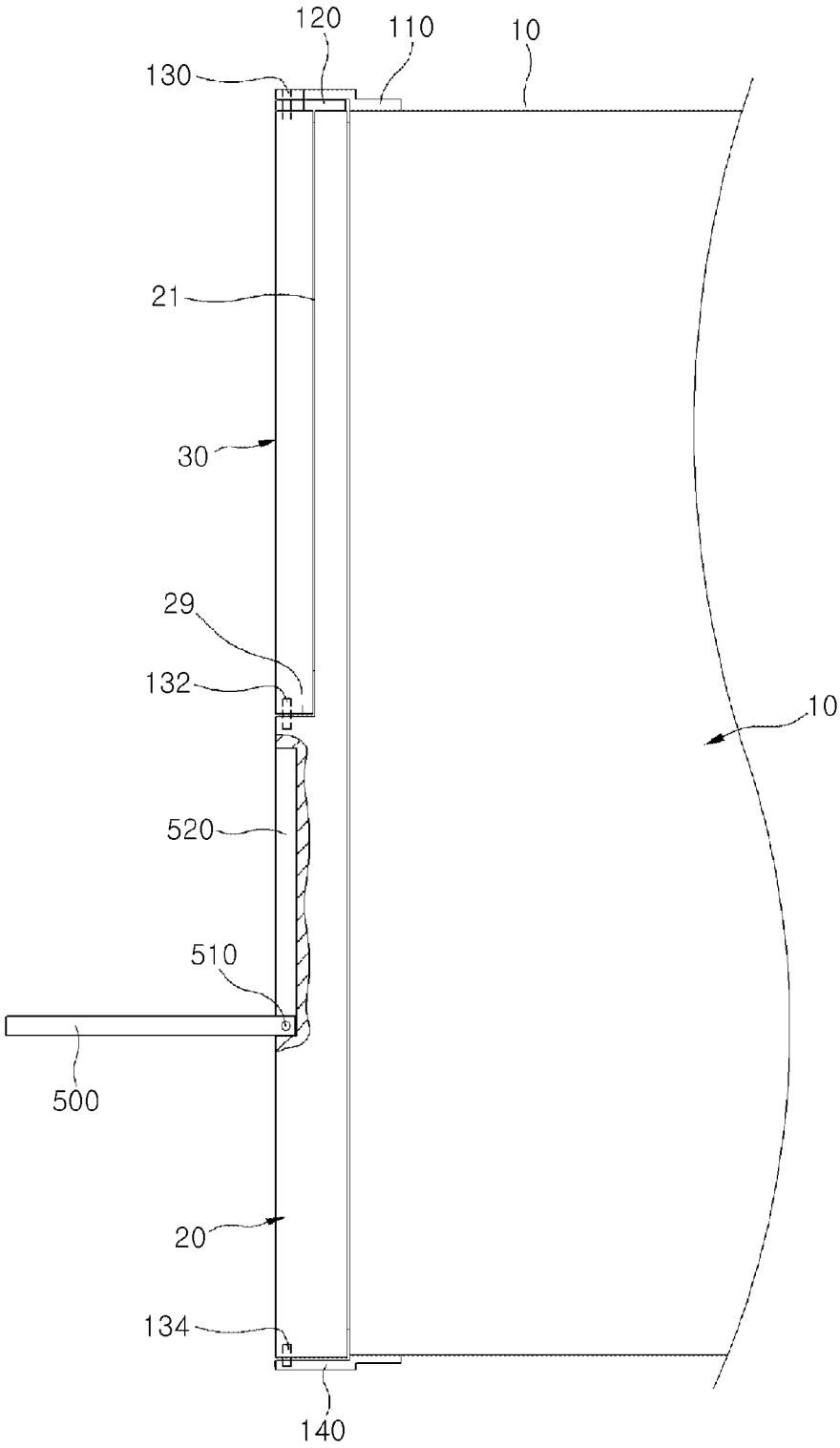
FIG. 9 is a side-sectional view of FIG. 5.

Different from the above implementations, a refrigerator shown in FIGS. 8 and 9 includes a third storage chamber and a third door 500 for selectively opening and closing the third storage chamber. Here, the third door 500 has a rotational direction that is different from the first door 20 and the second doors 30, for example, perpendicular to the rotational direction of the first door 20 or the second door 30.

The third storage chamber and the third door 500 will be described as follows. For convenient explanation sake, the refrigerator described in reference to FIG. 2 may further include the third storage chamber and the third door 500.

The third storage chamber is positioned in the first door 20 and it has a predetermined space for preserve food stuffs therein. The third storage chamber is typically configured to surround the defined space. That is, the third storage chamber has the predetermined space defined in the third door 500 and it is accessible from the outer side of the first door 20 basically. Not excluding that the third storage chamber is accessible from the inner side of the first door 20, the third storage chamber is accessible via the third door 500 provided in the outer surface of the first door 20. As configured of the surrounded space, the third storage chamber may have a structure allowing cold air to be supplied thereto.

As an example, the third storage chamber is functioned similarly to the second storage chamber 40. Here, the second storage chamber 40 and the third storage chamber do not have to be separated physically and they form a single space, accessible via the second and third doors 20 and 500, respectively.

Although it is possible that the second storage chamber 40 and the third storage chamber should be spaced apart a predetermined distance from each other, the second storage chamber 40 and the third storage chamber may be adjacent to each other, with configuration of a single space. The structure of the entire storage chamber may be simplified.

As mentioned above, the third door 500 may have the predetermined rotational direction different from the first door 20, for example, perpendicular to the rotational direction of the second door 30. Because of that, the third door 500 may be used as supporter in a state of being opened. This configuration enables re-categorized food stuffs. For example, having high usage frequency to be preserved in the second storage chamber 40 and the third storage chamber.

The coupling and opening/closing structure of the first, second and third storage chambers will be described as follows.

A first recess 26 recessed toward the cabinet, that is, the storage chamber is provided in a predetermined portion, for example, a lower portion of the first door 20. A third recess 36 is adjacently beyond the first recess 26 and the third recess 36 is used as handle for the second door 30. A fourth recess 500*a* is adjacently below the first recess 26 and the fourth recess 500*a* is used as handle for the third door 500.

In addition, a fifth recess 26*a* recessed toward the cabinet, that is, the storage chamber of the refrigerator. A second recess 28*a* is adjacently below the fifth recess 26*a* and the second recess 28*a* is used as handle for the first door 20.

As shown in FIG. 9, the third door 500 is coupled to the first door 20, rotatable with respect to a horizontal shaft 510. For example, an opening 520 is defined in a front surface of the first door 20 and the third door 500 is rotatably coupled to the opening 520. That is, the rotational shaft 510 of the third door 500 is arranged horizontally, and the pair of the rotational shafts 510 may be arranged in the opening 520 of the first door 20.

Figure 10:
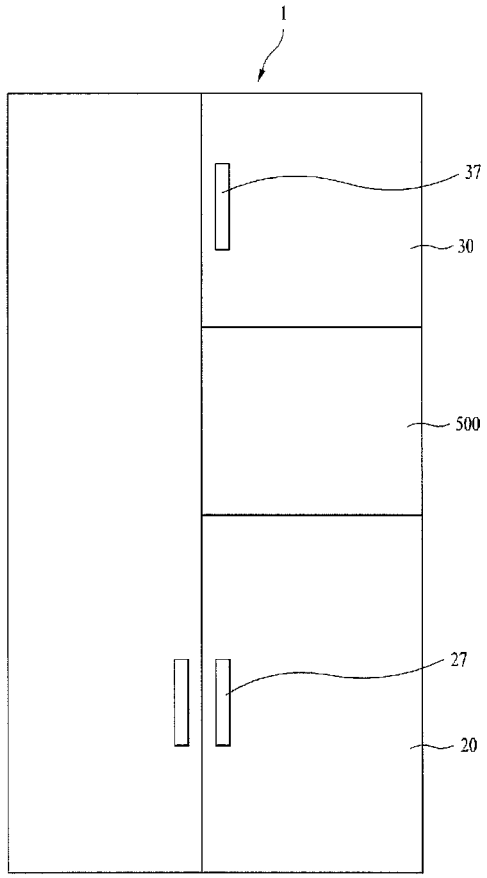
FIG. 10 is a front view illustrating a refrigerator.
Figure 11:
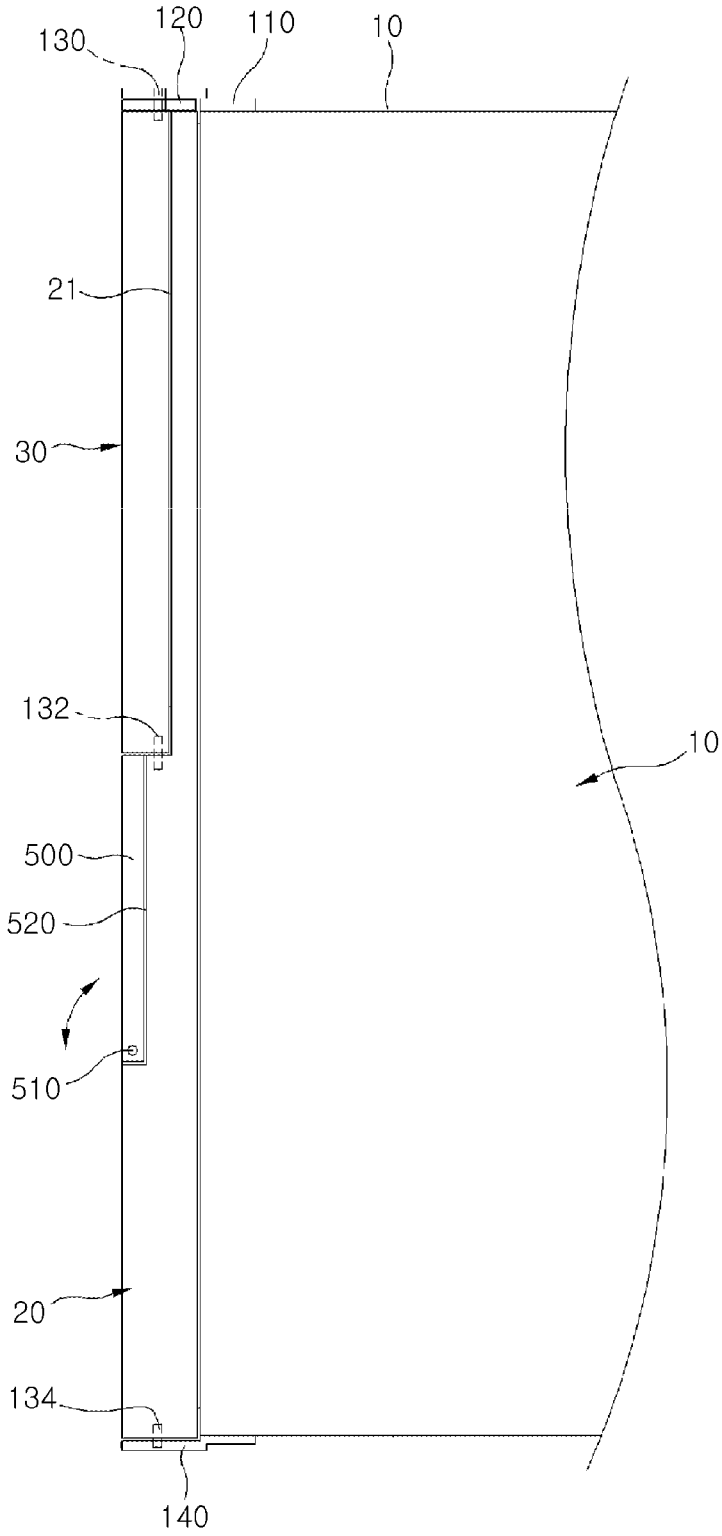
FIG. 11 is a sectional view of FIG. 10.

The installation structure of the handles for the first, second and third doors 20, 30 and 500 may not be limited. For example, as shown in FIGS. 10 and 11, auxiliary handles 37 and 27 may be provided in outer surfaces of the first and second doors, respectively, and the handle for the third door 500 may be a push-spring type. Such a push-spring type handle is installed in the third door 500. If the user pushes the third door 500, the third door 500 is opened automatically. The structure of the push-spring type handle is well-known in the art to which the present disclosure pertains and the detailed description thereof will be omitted accordingly.

Alternatively the handle for the third door may be installed in an outer surface of the third door 500 and the push-spring type may be applicable to the first and second doors 20 and 30.

As this implementation may not use the first recess 26 and the fifth recess 26*a* for handle installation, exterior beauty of the refrigerator may be enhanced.

Figure 12:
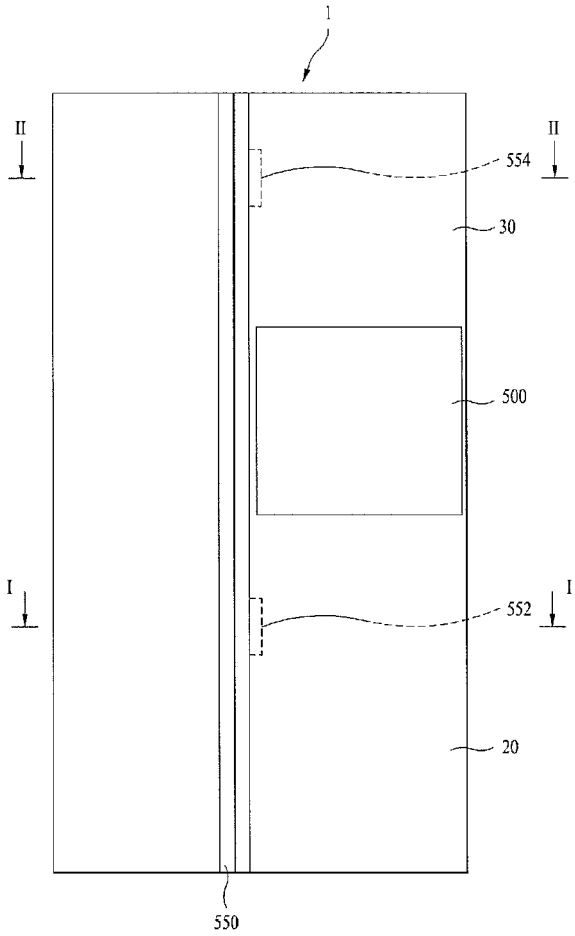
FIG. 12 is a front view illustrating a refrigerator.

In reference to FIGS. 12 to 14, a refrigerator will be described as follows.

Figure 13:
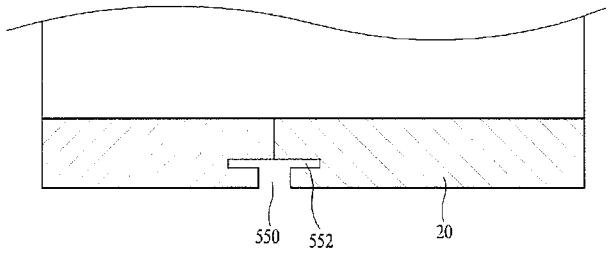
FIG. 13 is a sectional view of I-I line shown in FIG. 12.
Figure 14:
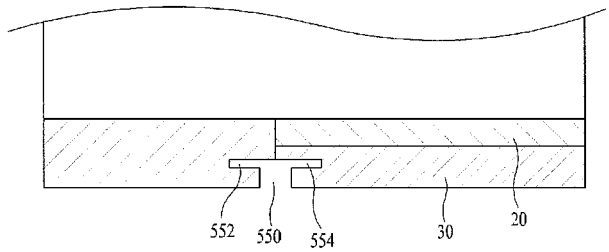
FIG. 14 is a sectional view of II-II line shown in FIG. 12.

A groove 550 recessed vertically is provided in a predetermined portion of the first door 20 and a first door recess 552 recessed horizontally and a second door recess 554 are provided in the groove 550 as shown FIG. 13 and FIG. 14. A third door handle may be a push-spring type. Alternatively, it is possible to open and close the third door 500 by using a third door recess provided horizontally in the groove 550. The corresponding drawings show that the recesses have a predetermined length. It is also possible to have the recesses along the entire length of the door.

Here, the above implementations may jointly use each structure of the handles. For example, the groove formed vertically, the recess formed horizontally and the push-spring structure.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a cabinet;

a first storage chamber defined within the cabinet;

a first door configured to open and close at least a portion of the first storage chamber, wherein a first depth of a first part of the first door is narrower than a second depth of a second part of the first door and a stepped portion of the first door is located where the first door changes from the first depth to the second depth;

a handle provided at the stepped portion of the first door that enables a user to open and close the first door;

a second storage chamber defined at a side of the first door, and configured to move with the first door when the first door moves between opened and closed positions; and a second door that is configured to open and close the second storage chamber, that enables access to the second storage chamber when the first door is oriented in a closed position, that is located at the first part of the first door that has the first depth, and that is spaced apart from the stepped portion of the first door, wherein, at the space between the stepped portion of the first door and a lower surface of the second door, the first door includes a recess that is recessed inward across the first door from a first portion of the first door that has the second depth and that is located at a first end of the first door to a second portion of the first door that has the first depth and that is located at a second end of the first door that is opposite the first end of the first door, wherein the recess enables the user to access the handle provided at the stepped portion of the first door through the space, and wherein a coupling part that rotatably couples the second door to the first door is located at the first portion of the first door that has the second depth.

2. The refrigerator of claim 1, further comprising:

a third storage chamber defined at a side of the first door, and configured to move with the first door when the first door moves between opened and closed positions; and a third door that is configured to open and close the third storage chamber and that enables access to the third storage chamber when the first door is oriented in a closed position.

3. The refrigerator of claim 2, wherein the second storage chamber and the third storage chamber are independent.

4. The refrigerator of claim 2, wherein the second storage chamber and the third storage chamber are located adjacent to each other.

5. The refrigerator of claim 2, wherein a rotational direction of the second door is the same as a rotational direction of the first door and a rotational direction of the third door is perpendicular to the rotational direction of the second door and the first door.

6. The refrigerator of claim 1, wherein the handle comprises a horizontal recess positioned at the stepped portion of the first door.

7. The refrigerator of claim 6, further comprising a vertical groove that is provided in the second door and that enables a user to pull open the second door.

8. The refrigerator of claim 1, further comprising:

a spring structure positioned at the second door and configured to open the second door.

9. The refrigerator of claim 1, further comprising:

a hinge assembly that is coupled to the first door and the second door and that establishes a rotational axis for the first door and the second door.

10. The refrigerator of claim 9, wherein the hinge assembly comprises a rotational shaft that establishes the rotational axis for the first door and the second door.

11. The refrigerator of claim 10, wherein the rotational shaft is located in the second door.

12. The refrigerator of claim 9, further comprising:

a first connection member configured to connect the hinge assembly to the cabinet.

13. The refrigerator of claim 12, further comprising:

a second connection member configured to connect the second door to the first door.

14. The refrigerator of claim 1, wherein a lower surface of the second door is rotatably coupled to the first door.

15. The refrigerator of claim 1, further comprising:

a first hinge that is coupled to the first door and that establishes a first rotational axis for the first door; and a second hinge that is coupled to the second door and that establishes a second rotational axis for the second door.

16. The refrigerator of claim 1, further comprising:

a first connection member configured to connect the first door to the cabinet.

17. The refrigerator of claim 16, further comprising:

a second connection member configured to connect the second door to the first door.

18. The refrigerator of claim 1, wherein an uppermost edge of the second door aligns with an uppermost edge of the first door when the second door is oriented in a closed position.

19. The refrigerator of claim 1, wherein the second door aligns with three edges of the first door when the second door is oriented in a closed position.

20. The refrigerator of claim 1, wherein, when the second door is oriented in a closed position, a front surface of the second door aligns with a front surface of the first door at the second part of the first door that has the second depth.

21. The refrigerator of claim 1, further comprising a housing that is configured to connect to the first door and define the second storage chamber provided at the first door.

22. The refrigerator of claim 1, wherein the second door spans an entire width of the first door.

23. The refrigerator of claim 22, wherein a width of the second door is substantially identical to a width of the first door.

24. The refrigerator of claim 1, wherein a rotational shaft of the first door is parallel to a rotational shaft of the second door.

25. The refrigerator of claim 1, further comprising:

a door basket positioned on an interior surface the first door, and configured to be accessible when the first door is oriented in an opened position.

26. A refrigerator comprising:

a cabinet;

a first storage chamber defined within the cabinet;

a first door configured to open and close at least a portion of the first storage chamber, wherein a first depth of a first part of the first door is narrower than a second depth of a second part of the first door;

a second storage chamber defined at a side of the first door, and configured to move with the first door when the first door moves between opened and closed positions;

a second door that is configured to open and close the second storage chamber and that enables access to the second storage chamber when the first door is oriented in a closed position, wherein a rotation direction of the second door is identical to a rotation direction of the first door;

a third storage chamber provided next to the first chamber;

a third door that is configured to open and close the third storage chamber, and that enables access to the third storage chamber when the first door is oriented in a closed position, wherein a rotational direction of the third door is different from the rotational direction of the first and second doors;

a first handle that is horizontally oriented, that is provided at the first door, and that is configured to facilitate access to the first storage chamber; and a second handle that is horizontally oriented in a manner aligned with the first handle, that is provided at the third door, and that is configured to facilitate access to the third storage chamber, wherein, at a space between the first handle and a lower surface of the second door, the first door includes a recess that is recessed inward across the first door from a first portion of the first door that has the second depth and that is located at a first end of the first door to a second portion of the first door that has the first depth and that is located at a second end of the first door that is opposite the first end of the first door, wherein the recess enables a user to access the first and second handles through the space, and wherein a coupling part that rotatably couples the second door to the first door is located at the first portion of the first door that has the second depth.

27. The refrigerator of claim 26, wherein an upper surface of the first door and an upper surface of the second door are disposed at an identical level.

28. The refrigerator of claim 27, further comprising:

a spring structure positioned at the third door and configured to open the third door.

29. A refrigerator comprising:

a cabinet;

a first storage chamber defined within the cabinet;

a first door configured to open and close at least a portion of the first storage chamber, wherein a first depth of a first part of the first door is narrower than a second depth of a second part of the first door;

a second storage chamber defined at a side of the first door, and configured to move with the first door when the first door moves between opened and closed positions;

a second door that is configured to open and close the second storage chamber and that enables access to the second storage chamber when the first door is oriented in a closed position;

a third storage chamber provided next to the first chamber;

a third door that is configured to open and close the third storage chamber and that enables access to the third storage chamber when the first door is oriented in a closed position, wherein a rotation direction of the third door is identical to a rotation direction of the first door;

a first handle that is centered at approximately a midpoint of a height of the first door; and a second handle that is centered at approximately a midpoint of a height of the third door, wherein, at a space between an upper surface of the second part of the first door and a lower surface of the second door, the first door includes a recess that is recessed inward across the first door from a first portion of the first door that has the second depth and that is located at a first end of the first door to a second portion of the first door that has the first depth and that is located at a second end of the first door that is opposite the first end of the first door, and wherein a coupling part that rotatable couples the second door to the first door is located at the first portion of the first door that has the second depth.

30. The refrigerator of claim 29, wherein the rotation direction of the third door is identical to a rotation direction of the second door.

31. The refrigerator of claim 29, further comprising:

a hinge assembly that is coupled to the first and second doors, and that establishes a rotational axis of the first and second doors.

* * * * *